United States Patent [19]

Lupo

[11] Patent Number: 4,878,259

[45] Date of Patent: Nov. 7, 1989

[54] WATERBED PEDESTAL WRAP

[75] Inventor: Anthony C. Lupo, Orlando, Fla.

[73] Assignee: Sunny's Waterbeds & Accessories, Inc., Orlando, Fla.

[21] Appl. No.: 257,135

[22] Filed: Oct. 11, 1988

Related U.S. Application Data

[63] Continuation of Ser. No. 70,337, Jul. 6, 1987, abandoned.

[51] Int. Cl.[4] ..... A47C 27/08; A47C 31/00

[52] U.S. Cl. ..... 5/451; 5/280

[58] Field of Search ..... 5/451, 450, 452, 280, 5/400; 297/DIG. 6; 312/257 A; 428/100

[56] References Cited

U.S. PATENT DOCUMENTS

| | | | |
|---|---|---|---|
| 2,763,875 | 9/1956 | Piontkowski | 5/493 |
| 3,066,321 | 12/1962 | Kintner | 5/484 |
| 3,563,599 | 2/1971 | Heumann | 297/DIG. 6 |
| 3,585,356 | 6/1971 | Hall | 5/451 |
| 4,103,375 | 8/1978 | Santo | 5/451 |
| 4,186,452 | 2/1980 | Underwood | 5/493 |
| 4,555,435 | 11/1985 | Walter | 428/100 X |
| 4,697,362 | 10/1987 | Wasserman | 428/100 X |
| 4,787,366 | 11/1988 | Bell | 5/493 |

FOREIGN PATENT DOCUMENTS

| | | | |
|---|---|---|---|
| 2652998 | 5/1978 | Fed. Rep. of Germany | 5/280 |
| 2172198A | 9/1986 | United Kingdom | 5/280 |

*Primary Examiner*—Alexander Grosz
*Attorney, Agent, or Firm*—Edward M. Livingston

[57] ABSTRACT

A one piece decorative wrap to cover waterbed pedestals which can be quickly and easily installed, even on an assembled waterbed. This pedestal wrap is installed using fastening material, such as self-stick tape or hook and loop-type fastening like material by attaching one end to the back of the pedestal, then around the side and front board of the pedestal with the other end being attached to the other side of the pedestal backboard. Since the excess length of the pedestal is secured on the pedestal backboard and does not show, one size of the pedestal cover fits all waterbeds, whether it be king, queen or super single. This unique pedestal wrap eliminates the requirement that the cover be installed prior to assembly because it can be quickly and easily installed by the consumer and added or changed at anytime after the waterbed is assembled.

5 Claims, 1 Drawing Sheet

WATERBED PEDESTAL WRAP

BACKGROUND OF THE INVENTION

This invention relates to waterbed components and accessories, and more particularly to decorative covers for waterbed pedestals.

Generally, waterbed mattresses are supported above the floor on a rectangularly-shaped wooden box called a pedestal. The pedestal can be made of veneer, oak or other wood and may be stained. Waterbed pedestals usually come in a standard color and are not customized to match the fabric and color of the waterbed padded caps or comforters or padded beds. Currently, if the consumer wants the pedestal to be covered with vinyl or fabric to match the rest of the waterbed, then the pedestal must be custom painted or upholstered by the manufacturer or distributor prior to shipment.

Various patent inventions have involved both decorative and structural aspects of waterbeds, but none have dealt directly with resolving the aforementioned problems associated with pedestals. For example, U.S. Pat. No. 4,103,375 by Santo shows decorative waterbed frames attached to the sides of the bed by VELCRO type fasteners; U.S. Pat. No. 4,554,039 by James shows padded waterbed rails; U.S. Pat. No. 4,089,497 by Miller et al discloses rail caps which fit over the side rails; U.S. Pat. No. 4,514,871 by Fisher shows a padded cap to fit over the end rails of the waterbed; and U.S. Pat. No. 3,546,725 by Tambascio shows decorative trim strip for normal bed frames. Other U.S. Patents, such as Nos. 4,389,741 by Larson; 4,190,916 by McMullan; 3,585,356 by Hall; and 4,109,887 by Wakeland, deal with waterbed construction but are not deemed pertinent to the instant invention.

Thus, there are currently many problems regarding the decorative aspects of waterbed pedestals which it is the intention of the instant invention to resolve. Now whenever a purchaser desires to have waterbed pedestals covered, then a customized cover must be upholstered, painted or lacquired to the pedestal at the place of manufacture and shipped, thereby causing additional shipping weight and inventory costs of carrying various colors and sizes of pedestals. The instant invention provides a pedestal cover which can be quickly and easily installed after the bed has been assembled right in the purchaser's residence. Furthermore, the customer can change or add the pedestal wrap at any time.

Another problem with current pedestals is that the covers must be custom ordered to fit three different sizes, king, queen and super single whereas the instant invention fits all sizes. A further advantage of the instant invention is that the waterbed pedestal can be made with plain particle board, plywood or the like, without being stained since it can be easily covered later as the consumer desires while at the same time reducing cost to consumers.

Thus, by resolving the many problems discussed above, this invention will save substantial costs on the manufacturing and distribution levels, thereby providing a savings to the consumer as well.

SUMMARY OF THE INVENTION

The primary object of this invention is to provide a unique decorative cover for the pedestals of waterbeds.

A corollary object of this invention is to provide a universal pedestal cover that fits all sizes of waterbeds—king, queen or super single.

An even further object of this invention is to provide such a pedestal cover which is quick and easy to install, even on an assembled waterbed.

An additional object of the invention is to provide the pedestal cover with the above advantages which yields substantial cost savings to the retailers, distributors and consumers by eliminating the current requirement that pedestals be customized during manufacture, that different sizes of customized pedestals be made, and that pedestals be shipped already customized at extra shipping cost.

The instant invention accomplishes the above objects, as well as additional objects which will become more readily apparent, by providing a one-piece pedestal cover which, wraps around the pedestal of a waterbed and attaches to the pedestal by tape, or hook and loop-type fastening material such as that sold under the trademark VELCRO or other fastening means along the side thereof. The pedestal wrap can be shipped in a roll and sold in one size since any excess length of the pedestal cover is hidden around the back of the pedestal where it cannot be seen. Thus, the pedestal wrap can be changed or added quickly and easily whenever the consumer desires a new color or design.

Other objects, advantages and features of the invention will become more readily apparent from the following detailed description of the specific embodiments thereof when read in conjunction with the accompanying drawings.

BRIEF DESCRIPTION OF THE DRAWINGS

The drawings appended to this application are as follows.

DETAILED DESCRIPTION OF THE PREFERRED EMBODIMENT

Figure 1:
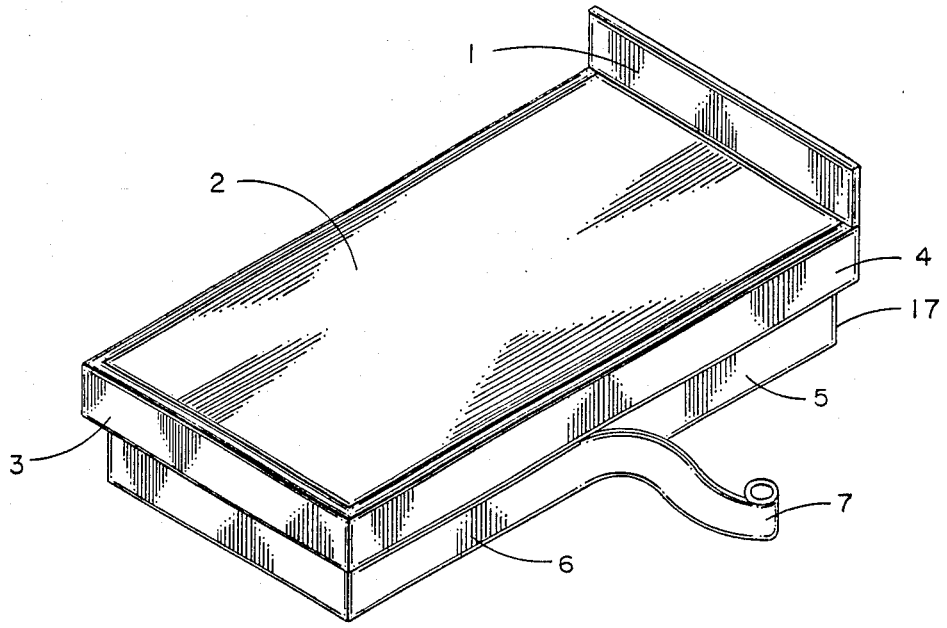
FIG. 1 is a perspective view of a waterbed in general showing the pedestal wrap being applied to the waterbed.

Referring in detail to the drawings the perspective view of the waterbed in FIG. 1 shows the major components of the waterbed consisting of the waterbed mattress 2 surrounded by a frame 4, and headboard 1, all supported by a decking (not shown) on the pedestal 5. These components are normally made of plywood, veneer, oak or other type of wood.

The pedestal wrap or cover 6 which is the subject of this invention is shown partially installed in FIG. 1. The portion of the pedestal wrap 6 not yet installed is contained in the roll 7. The pedestal wrap 6 is fastened to the pedestal 5 and wraps around the back of the pedestal 17. The pedestal wrap 6 may be made of vinyl, leather, cloth or other material.

Figure 2:
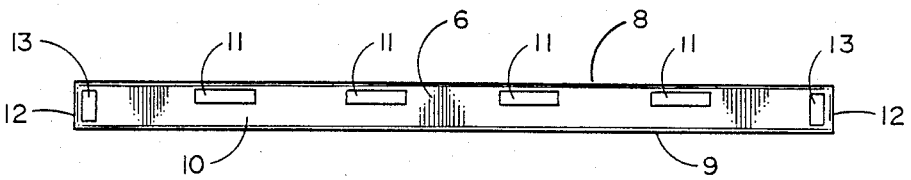
FIG. 2 is a reverse side view of the pedestal wrap.

On the reverse side of the pedestal wrap 10 illustrated in FIG. 2, fastening material 11, such as self-stick tape or hook and loop-type fastening material, is glued or attached along the top of the wrap 8 and a vertical strip of fastening material 13 is attached to each end of the wrap 12. The pedestal wrap bottom 9 may also contain a strip of fastening material, if desired, but same is unnecessary to hold the pedestal wrap 6 firmly on the pedestal 5.

Figure 3:
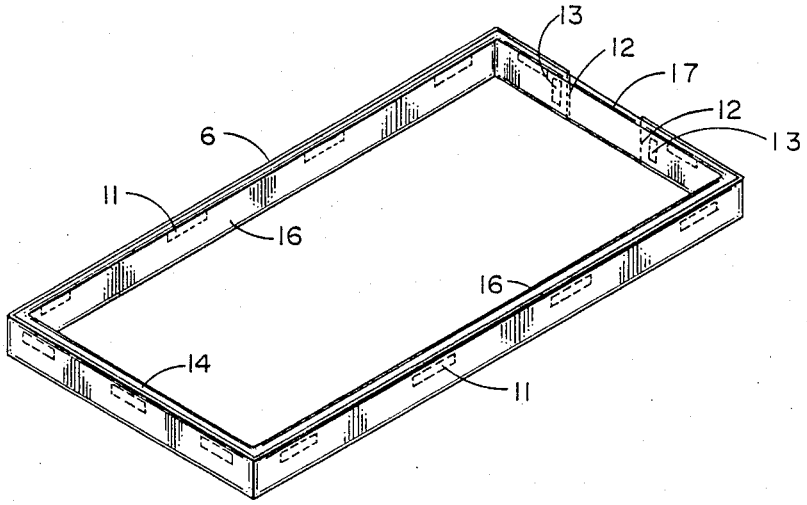
FIG. 3 is a perspective plan view of a waterbed pedestal showing the pedestal wrap installed.

The attachment of the pedestal wrap 6 to the pedestal 5 is best shown in the plan view of FIG. 3. The pedestal wrap 6 is installed by first attaching the end 12 on the backboard of the pedestal 17 using the fastening material 13, then along pedestal side board 16, the end board 14 and the second side board 16 and finally on the other end 12 to the backboard of the pedestal 17. Since any extra length of the pedestal wrap 6 is hidden when it is attached to the backboard of the pedestal 17, one size wrap can be used to fit any size of waterbed, whether it be a king, queen or super single.

Thus, as described hereinabove, the instant invention provides a unique waterbed wrap which offers numerous and significant advantages to waterbed manufacturers, distributors and purchasers not available heretofore. Unlike prior customized pedestals where the material must be installed before assembly, at the place of manufacture and shipped at extra cost to the distributor, retailer or consumer, the instant pedestal wrap can be installed quickly and easily even after the waterbed has been assembled. Moreover, one size of pedestal wrap fits all sizes of waterbeds, thereby eliminating the requirement that the retailer or distributor carry a large inventory of several sizes and colors of customized pedestals. Finally, this invention provides the user the flexibility of being able to add or change the pedestal wrap over and over again to match the design of the padded caps, comforters or other decorative aspects of waterbeds.

While one specific embodiment of the invention has been described in detail hereinabove, it is to be understood that various modifications may be made from the specific details described hereinabove without departing from the spirit and scope of the invention as set forth in the appended claims.

In addition to tape or hook and loop fastening material, such as Velcro, other fastening means may be used to secure the pedestal wrap 6 to the pedestal 5. For instance, snaps could be used with male snap components on the wrap 6 and matching female snap components on the pedestal 5. By using snaps and merely pressing the male snap on the pedestal wrap 6 to the matching female snap component on the pedestal 5 would securely fasten the pedestal wrap 6 around all four sides of the pedestal 5. Another means for fastening would include a elastic strips incorporated into the lining of the pedestal wrap 6. In this manner, the pedestal wrap 6 could be stretched over and around the entire pedestal 5. An even further means of attaching the pedestal wrap 6 around the pedestal 5 would be to first secure the wrap 6 to a piece of free-standing cardboard and then place the cardboard around the perimeter of the pedestal 5.

Having described in detail my invention, I claim the following:

1. In combination with a waterbed having a frame and a watermattress resting on a generally rectangular pedestal having four substantially planar outer surfaces, a rollable, flexible cover or wrap comprised of a decorative material having attached, integral fastening means adapted to cooperate with the outer surfaces of said pedestal to removably secure the cover in direct contact with said outer surfaces, said cover being of a sufficient length and width to cover a substantial portion of all four outer surfaces.

2. The pedestal wrap of claim 1 wherein the fastening means is hook and loop-type fastening material.

3. The pedestal wrap of claim 1 wherein the fastening means is tape.

4. The pedestal wrap of claim 1 wherein the fastening means consists of male snap components on the wrap with matching female snap components on the sides of the waterbed pedestal.

5. The pedestal wrap of claim 1 wherein the fastening means consist of elastic on the perimeter thereof.

* * * * *